US005694993A

United States Patent [19]

Cameron

[11] Patent Number: 5,694,993

[45] Date of Patent: Dec. 9, 1997

[54] END DOG CARRIAGE TWIN

[75] Inventor: Robert E. Cameron, deceased, late of Warrenton, Oreg., Carol Ann Rodriguez, personal representative

[73] Assignees: Curtis G. Cameron, Yuma, Ariz.; Bobbie Lynn Cameron, Roseburg, Oreg.; Carol A. Rodregues

[21] Appl. No.: 620,491

[22] Filed: Mar. 22, 1996

[51] Int. Cl.[6] ..... B27B 31/00; B65B 47/00

[52] U.S. Cl. ..... 144/245.1; 83/425; 83/435.11; 144/242.1; 198/468.2; 198/468.9; 414/746.3; 414/753

[58] Field of Search ..... 83/425, 435.11, 83/437.1, 731; 144/242.1, 245.2, 245.3, 250.17, 250.21, 377, 378, 245.1; 198/468.01, 468.2, 468.9; 414/753, 746.3

[56] References Cited

U.S. PATENT DOCUMENTS

| | | | |
|---|---|---|---|
| 2,383,195 | 8/1945 | Horman | 83/435.11 |
| 4,009,623 | 3/1977 | Detjen | 144/250.17 |
| 4,949,769 | 8/1990 | Cameron | 144/245.2 |
| 5,011,001 | 4/1991 | Cameron | 198/468.2 |

*Primary Examiner*—W. Donald Bray
*Attorney, Agent, or Firm*—Delbert J. Barnard

[57] ABSTRACT

Two independently operable log delivery systems including a first carriage (A) and a second carriage (B), each carriage the mirror image of the other, each carriage including an upper pair of rollers (80,82) and a lower pair of rollers (84,86), the rollers oriented at ninety degree angles to each other. A main carriage support beam (60) carries each conveyor on pairs of upper rails (70,72) and lower rails (74,76). Upper rollers (80,82) are biased against upper rails (70,72) by means of a torque shaft (108). A dog (32) is mounted at an angle on a dog shaft so that the dogs of each carriage do not intercept one another should the carriages move past each other.

17 Claims, 4 Drawing Sheets

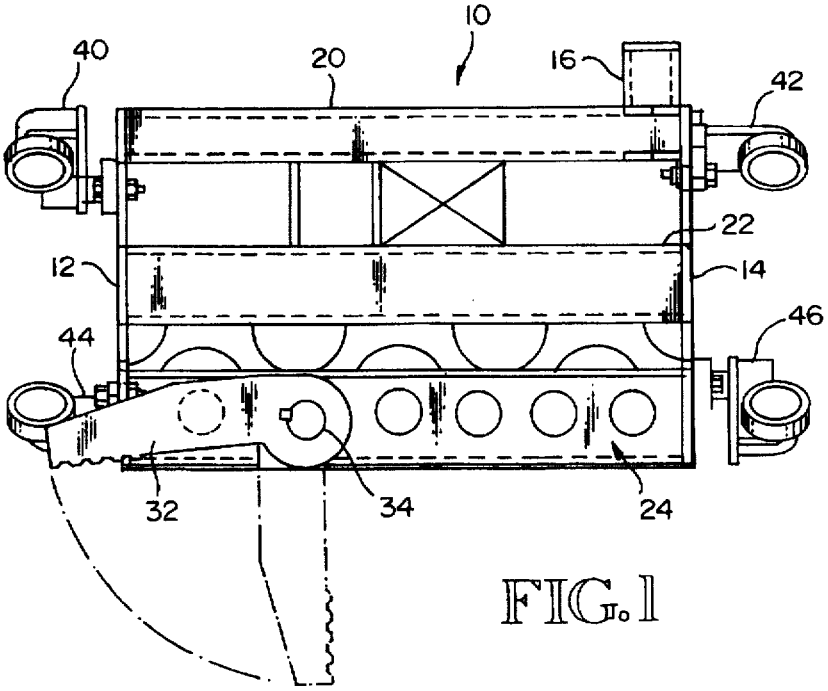
FIG. 1
FIG. 5
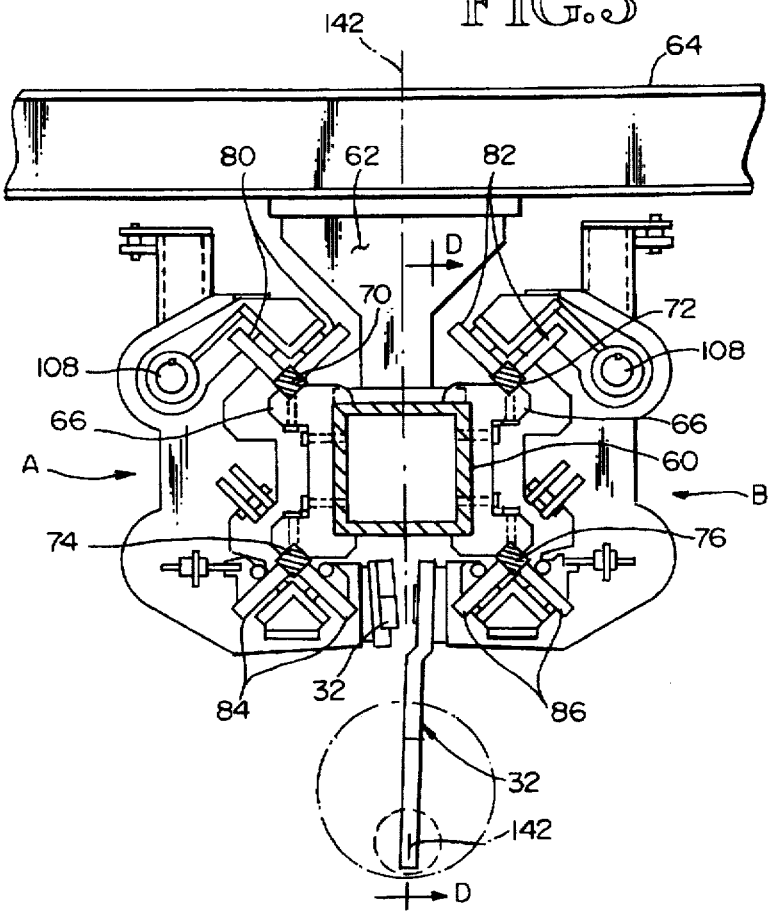

END DOG CARRIAGE TWIN

TECHNICAL FIELD

The present invention pertains to lumber mill machinery for picking up a log and feeding* it through a cutting station and, more particularly, to a carriage twin design, a novel end dog, and a conveyor track for carrying the carriages.

BACKGROUND

My prior U.S. Pat. No. 5,011,001, entitled, "Twin Carriage System," issued Apr. 30, 1991, and my prior U.S. Pat. No. 4,949,769, entitled, "Log Delivery Mechanism," issued Aug. 21, 1990, disclose a log carriage system for delivering logs to overhead carriages for pick up and feed through a cutting station. The carriage design disclosed in the '001 patent includes a pair of front and back carriage sections, each interconnected by a hydraulic cylinder. Each front and back carriage section together comprise a carriage, either carriage "A" or carriage "B." Carriage A rides on one side of a conveyor track, while carriage B rides on the other. End dogging apparatus are carried on each carriage, which, together with the hydraulic cylinders interconnecting the carriages, function to clamp a log with a sufficient force to control the log and feed it through a cutting station. Each of the two carriages is independently operable and in its preferred mode, operates alternately in time; while one carriage is taking a log through the cutting station, the other carriage quickly returns to its initial station to accept the next log for processing. The present invention is an improvement over the system disclosed in my aforementioned patents.

In addition, in the past I have proposed an end dog design that is a dog leg design in that the end dog includes a jog so that the lower free end of the dog is positioned inwardly on the center line of the system so that it can dog a log in the center of the log. This idea has been used by others to design a carriage system wherein, with one dog lowered and the other dog raised, the carriages can pass each other without contact. This has the advantage of added safety should a control malfunction occur. The present invention is also an improvement over this prior concept of mine.

DISCLOSURE OF THE INVENTION

Briefly described, the present invention is part of a log delivery system that includes a main carriage support beam having a pair of upper rails and a pair of lower rails. The pair of upper rails are spaced from one another on opposite sides of a vertical centerline of the main beam. The pair of lower rails, likewise, are spaced from one another on opposite sides of the vertical centerline. Each upper rail includes an inwardly, upwardly-inclined rail surface and an outwardly, upwardly-inclined rail surface, and each lower rail includes an inwardly, downwardly-inclined rail surface and an outwardly, downwardly-inclined rail surface. The log delivery system includes first and second log carriages mounted for longitudinal movement on the main carriage support beam. Each carriage includes front and back carriage sections, each carriage section including a dog for clamping a log. The dog is pivotally mounted to the carriage so that it can be lowered into a clamping position and raised in order to release a log. Each carriage section includes an upper pair of rollers adapted to roll on the inwardly, upwardly- and outwardly, upwardly-inclined rail surfaces of the main beam. Each carriage section also includes a lower pair of rollers adapted to roll against the inwardly, downwardly- and outwardly, downwardly-inclined rail surfaces of the main beam. The first and second carriages are adapted to move on opposite sides of the main beam so that it is possible for each carriage to move past each other.

Preferably, the inwardly, upwardly-inclined and outwardly, upwardly-inclined pairs of rail surfaces are oriented 90° to each other, and the inwardly, downwardly and outwardly, downwardly pairs of inclined rail surfaces are oriented 90° to each other. Likewise, the pair of upper rollers and the pair of lower rollers are oriented 90° to each other.

Preferably, each carriage includes first and second pairs of upper rollers and first and second pairs of lower rollers, the pairs of upper and lower rollers being spaced longitudinally from each other on the carriages.

A torque mechanism is provided on each carriage section for biasing at least one of the upper pairs of rollers and one of the lower pairs of rollers against their respective rail surfaces. Each carriage, having four pairs of rollers, has an upper and lower pair rotatably, yet fixedly mounted to the carriage and an upper and lower pair mounted to the carriage in a biased manner. When a log is dogged, the fixed pairs of rollers are forced against their respective rail surfaces and act to guide the carriages along the conveyor track. When a log is released, the biased rollers function to keep the carriages aligned and guided along the conveyor track as the carriages are returned to dog another log.

According to one aspect of the present invention, each dog is mounted to its respective carriage section in a slanted or angled manner such that the distal end or free end of each dog is aligned with the vertical centerline of the main beam, and the upper portion of each dog, which portion is mounted to a carriage, is laterally outwardly of the vertical centerline. In this manner, if one dog is lowered and the other dog is raised, or if both dogs are raised, the carriages can pass each other without contact. Only when both dogs are lowered and their distal ends cross the centerline will there be contact if the carriages pass.

An advantage provided by the present invention is a simplified log carriage design that has fewer components than prior art systems, making these carriages inexpensive to build, install and operate. The carriages of the present invention are also relatively lightweight so that the carriages can be easily and quickly operated, especially when processing smaller logs. As timber harvesting restrictions continue, lumber mills are faced with the prospect of processing smaller and smaller logs. The endless supply of large, old growth timber is a thing of the past. The present invention is directed to the future raw material supply and its high cost to a sawmill, with the goal being high lumber and value recovery assured from every log.

These and other advantages of the present invention will become apparent from the following detailed description of the best mode, and accompanying drawings, and the claims, which are incorporated herein.

BRIEF DESCRIPTION OF THE DRAWINGS

Referring to the figures, in which like reference numerals refer to like parts throughout, FIG. 1 and FIG. 2 are side elevation views, taken along the line D—D of FIG. 5, of carriage B of the present invention, FIG. 1 being a front section of carriage B and FIG. 2 being a back section of carriage B;

FIG. 5 is an end elevation view of both carriage A and carriage B, with carriage A shown on the left;

BEST MODE FOR CARRYING OUT THE INVENTION

Figure 2:
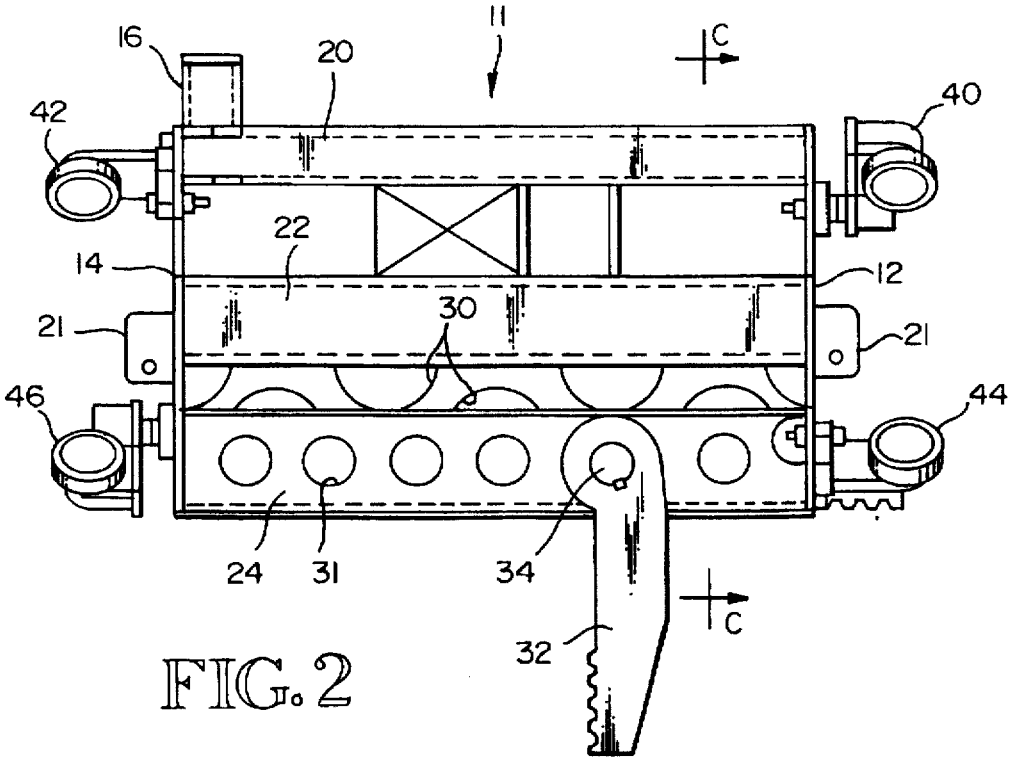
Figure 3:
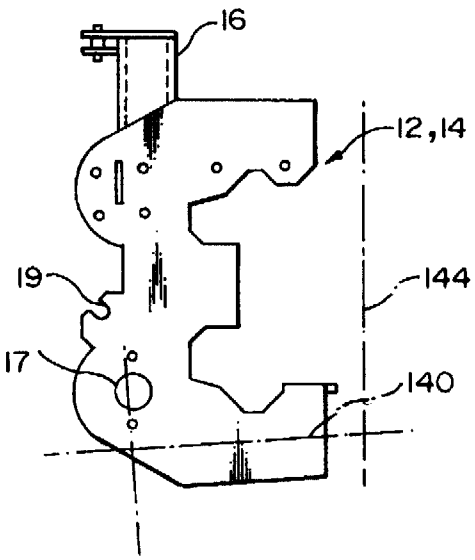
FIG. 3 is an elevation view of an end plate of carriage A of the present invention.

The present invention includes a pair of carriages, which will be referred to as carriage A and carriage B. Either of these two carriages can operate to dog a log and feed the log through a cutting station. For example, while carriage A is carrying a log through the cutting station, carriage B can be accepting and dogging the next log to be processed. The cutting station and the log delivery mechanism for presenting logs for pick up by the carriages A and B form no part of the present invention. The present invention is directed at the design of each carriage and the conveyor track. Carriage sections 10, 11 in FIGS. 1, 2 comprise carriage A. Carriage section 10 is commonly referred to as the front section, carriage section 11, the back section. Both carriages A and B are identical, mirror images of each other, so FIGS. 1,2 are also representative of the design of carriage B. Front and back carriage sections 10, 11 each include a pair of end plates 12, 14. A representative end plate 12, 14 is shown in FIG. 3, end plates 12, 14 being mirror images of each other. End plate 12, 14 is E-shaped so that it can straddle one side of a conveyor track for longitudinal back and forth movement. An arm 16 is mounted to one of the end plates 12, 14 for attachment to a suitable pantograph for power and control lines and cables. End plates 12, 14 include a flame cut hole 17 for a torque shaft, discussed later, and a notch 19 for attachment to a drive cable.

The drive mechanism for reciprocating carriage A also comprises no part of the present invention and any suitable drive mechanism, well known in the art, can be adapted for moving both carriages A and B. A suitable drive mechanism is disclosed in my prior U.S. Pat. No. 4,697,487, entitled "Adjustable Cable Driven Carriage System and Method", and U.S. Pat. No. 5,011,001, entitled "Twin Carriage System".

With these foregoing drive mechanisms, a dog clamping means also needs to be provided. It should be kept in mind that the end dogs do not necessarily provide the clamping forces for holding a log. Additional clamping apparatus is typically provided. Preferably, however, the present invention is coupled to the drive mechanism disclosed in my co-pending patent application Ser. No. 08/576,445, entitled "Log Delivery System", filed Dec. 21, 1995 herewith. As shown in FIG. 2, carriage 10 is provided with a pair of cable anchors 21, to which drive cables are secured, as discussed in the aforementioned patent application. The drive mechanism disclosed in this co-pending application has the advantage of locating the dog clamping apparatus off of the carriages, thus reducing their weight, simplifying their design, and allowing clamping of any length of log.

Figure 4:
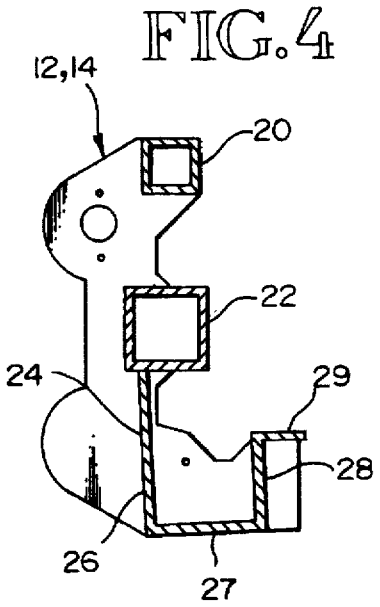
FIG. 4 is a sectional view, taken along the line C—C of FIG. 2, showing the structural beam components of the carriage section of FIGS. 1 and 2.

Referring to FIG. 4, each front and back carriage section includes an upper tubular box beam 20 and a middle tubular box beam 22, both of which are welded between end plates 12, 14. A lower formed ⅜" plate structure 24 includes a first vertical leg 26, a lower horizontal leg 27, a third vertical leg 28 and a flange 29. Formed plate structure 24 also is welded between end plates 12, 14. End plates 12, 14, tubular beams 20, 22, and formed plate 24 comprise the main structure of each carriage section. Legs 26, 28 of plate 24 include flame cut holes 30, 31. These holes serve two purposes. One, they remove weight from the carriages without significantly weakening the carriages. Two, holes 30 shorten the length of weld beads where plate 24 joins middle beam 22.

Front and back carriage sections 10, 11 each include an end dog 32 that is keyed to a dog shaft 34, which is rotatably supported by plate structure 24. End dog 32 and dog shaft 34 are discussed in more detail with reference to FIGS. 8 and 9.

Each front and back carriage section also includes four roller arm assemblies 40, 42, 44, 46. Each arm assembly 40, 42, 44, 46 carries a pair of rollers, only one roller of which is illustrated in FIGS. 1,2. Roller arm assemblies 40, 42, 46 are discussed with reference to FIG. 7.

In FIG. 5, carriages A and B are shown in end elevation. Carriage A is the identical mirror image of carriage B. The conveyor track on which carriages A and B roll is comprised of an elongated tubular main beam 60 supported by suspension brackets 62. Suspension brackets 62 are mounted to any suitable support structure 64 capable of supporting the log delivery system of the present invention.

Figure 6:
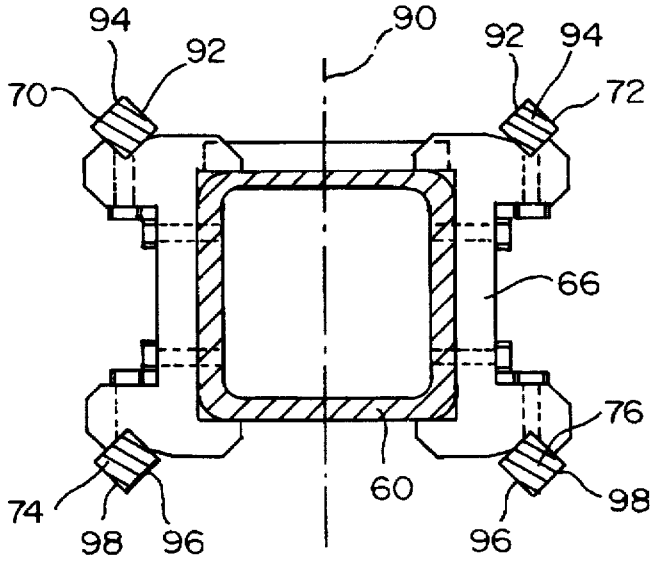
FIG. 6 is an enlarged detail view of the conveyor track of the log delivery system of the present invention.

A plurality of track mount brackets 66 are bolted to main beam 60 at spaced intervals along the length of main beam 60. Four elongated square bars 70, 72, 74, 76 are bolted to brackets 66 and extend horizontally along the length of the conveyor track. Each bar 70, 72, 74, 76 forms a vee rail on which travel rollers 80, 82, 84, 86 of carriages A and B. In FIG. 6, vee rails 70, 72 comprise a pair of upper rails, and vee rails 74, 76 comprise a pair of lower rails. Vertical centerline 90 bisects main beam 60 and is illustrated to show that both the upper rails 70, 72 and the lower rails 74, 76 are spaced on opposite sides of the conveyor track, i.e. on the opposite sides of centerline 90. Each upper rail 70, 72 includes an inwardly, upwardly-inclined rail surface 92 and an outwardly, upwardly-inclined rail surface 94. Each lower rail 74, 76 includes an inwardly, downwardly-inclined rail surface 96, and an outwardly, downwardly-inclined rail surface 98. The rollers for each carriage A and B roll along rail surfaces 92, 94, 96, 98 as carriages A and B move independently longitudinally along the conveyor track.

Figure 7:
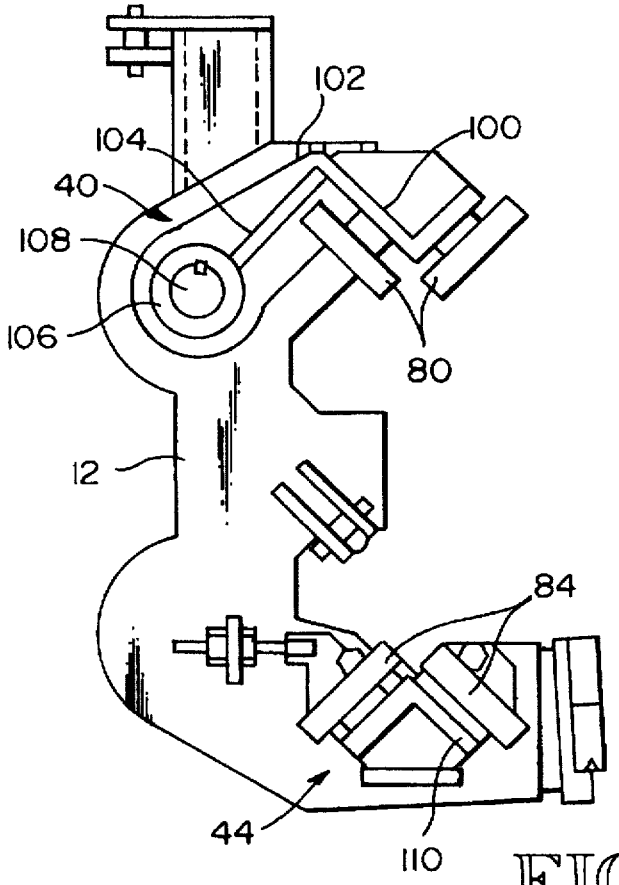
FIG. 7 is an enlarged detail view of the roller arm assemblies of the carriage of FIG. 1.

In FIG. 7, a generic end plate 12 is shown with an upper arm assembly 40 and a lower arm assembly 44. Upper arm assembly 40 includes a V-shaped bracket 100 to which rollers 80 are rotatably mounted. An arm 102 and a brace 104 are welded to each other and to V-shaped bracket 100. A short sleeve segment 106 is welded to brace 104 and arm 102 and itself is keyed to a torque shaft 108. Torque shaft 108 is rotatably journaled through end plate 12 and is coupled to a torque adjuster, discussed with reference to FIG. 8. Vee rails 70, 72, 74, 76 and rollers 80, 82, 84, 86 prevent the carriage sections from rotating about main beam 60 when a log is dogged and moved through a cutting station.

Lower arm assembly 44 includes a V-shaped bracket 110 that is secured directly to end plate 12. Rollers 84 are rotatably secured to bracket 110. As such, arm assembly 40 is rotatably adjustable to bias its rollers onto their vee rail. Arm assembly 44 is fixed in the sense that its rollers are permanently positioned relative to end plate 12.

Upper arm assembly 40 and lower arm assembly 44, as well as upper arm assembly 42 and lower arm assembly 46 of FIG. 1, are interchangeable in that the design of the lower arm assemblies can replace the upper arm assemblies and vice versa, as discussed in more detail with reference to FIG. 9.

Figure 8:
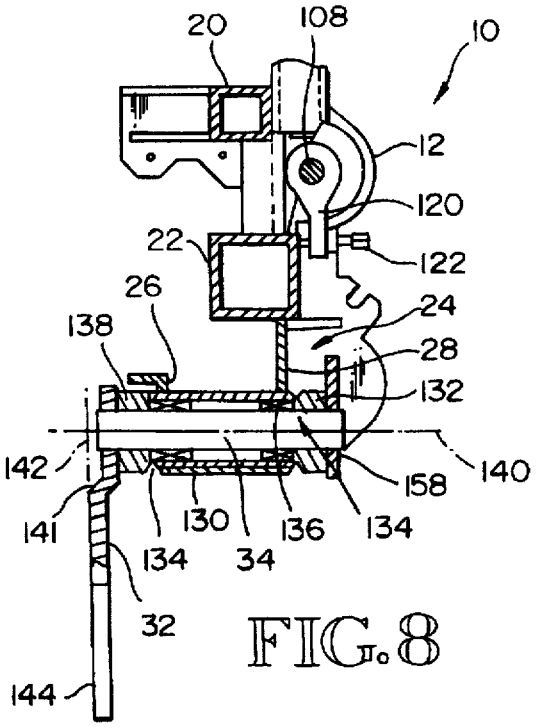
FIG. 8 is a sectional view taken along the line A—A of FIG. 9, showing a torque shaft and a dog shaft and accompanying bearing components of the carriage sections of FIG. 5.

In FIG. 8, the torque shaft 108 of the upper arm assembly is shown extending through end plate 12. A torque arm 120 is keyed to shaft 108 and extends downwardly to the middle beam 22 of the carriage. A torque adjuster 122 in the form of a threaded bolt threads through arm 120 and is biased against beam 22 to provide a counterclockwise torque on shaft 108, which torque biases the associated rollers against their respective vee rail.

Dog shaft 34 is rotatably carried within a cylindrical sleeve 130 that is supported within legs 26, 28 of lower plate structure 24. A pair of bronze thrust washers 134 are positioned between a pair of bearings 136 and a pair of collars 138 on shaft 34. A crank arm 158 is keyed to dog shaft 34 at its outer end. A hydraulic motor is coupled to crank arm 158 to raise and lower end dog 32.

As illustrated in FIG. 8, carriage section 10 includes an outer front side, which is the side of carriage 10 on the right, as shown. It is the side on which torque adjuster 122 can be seen. The inner side of carriage 10 is on the left, and it is the side facing the conveyor track and from which a full view of end dog 32 can be seen. In the claims, the terms "laterally outwardly" and "laterally inwardly" are used. "Laterally outwardly" is in the direction toward the outer side of a carriage section, and "laterally inwardly" is in the direction toward the inner side of a carriage section.

As shown in FIG. 8, dog shaft 34 has its axis 140 aligned at an angle from horizontal. This is due to the configuration of plate structure 24, shown in FIG. 4. Horizontal leg 27 of plate structure 24 is not actually horizontal, but instead is angled upwardly from leg 26 to leg 28. Thus, dog shaft 34 is rotatably carried at an angle, or at a slant, by plate structure 24.

End dog 32 includes a dog leg or shoulder 141. The upper portion of end dog 32, which portion is mounted to dog shaft 34, is offset outwardly from the lower portion of end dog 32. In other words, the upper portion of end dog 32 is spaced from a vertical centerline 142 passing through the distal or free end 144 of dog 32. The angled orientation of dog shaft 34 aligns end dog 32 at an angle to vertical line 142. This is an advantageous feature of the present invention.

Referring to FIG. 5, end dog 32 of carriage B is shown extended down. Carriage A's end dog 32 is shown retracted up. With carriage A's dog up, the dog is swung laterally off of vertical line 142. In this position, the dogs of both carriages will not collide with one another when carriages A and B are moved past each other. A collision could bend up a carriage so bad that it might effectively destroy a carriage. If carriage B's dog was also up, the same would be true—there would not be a collision of the dogs. Only when both carriage dogs are down is there potential for a collision of the distal ends of the end dogs. This is an improvement over my prior upright dog leg design because when the upright dogs are both raised, the dogs will intercept when the carriages are moved past each other. Raising the upright dog leg dogs does not move them off of centerline. Ideally, the carriages are not moved past each other with their dogs properly positioned, but control malfunctions do occur, and the present design provides an added safety feature.

Figure 9:
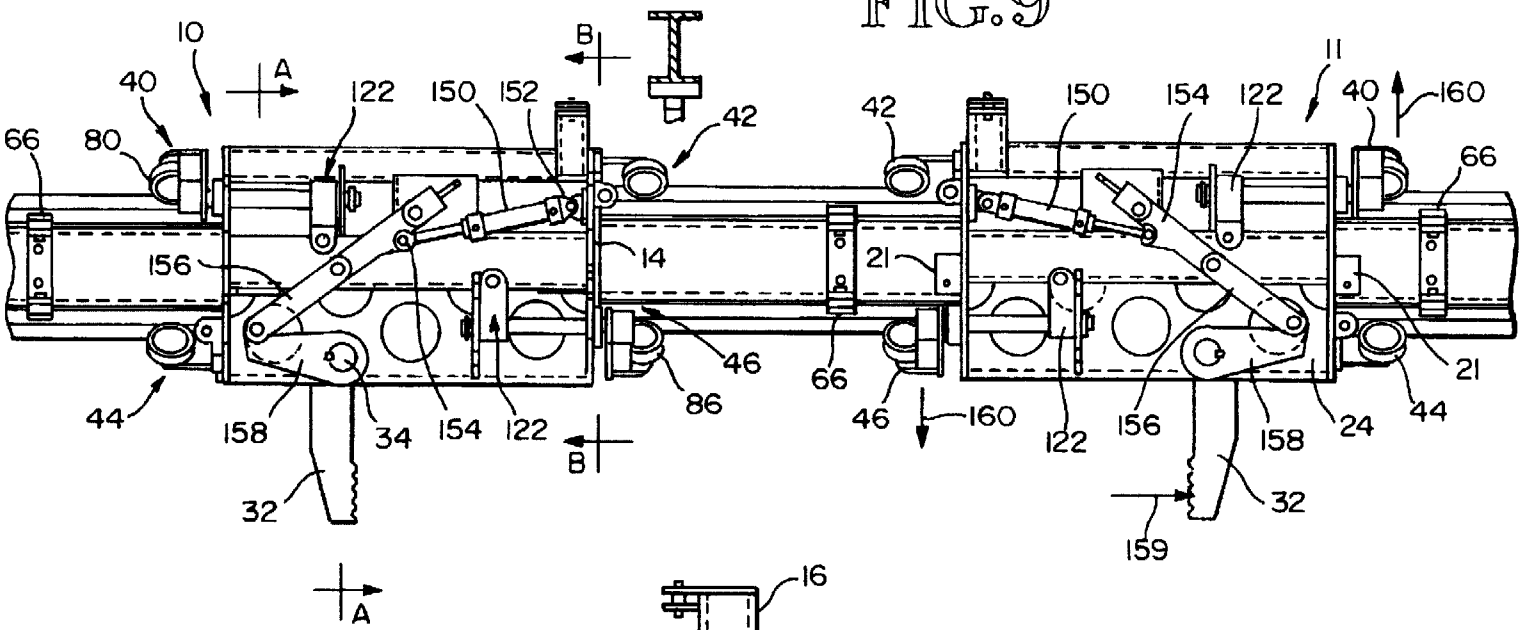
FIG. 9 is a side elevation view of carriage A.

In FIG. 9, a linear hydraulic motor 150 for retracting and extending end dog 32 is mounted at one end 152 to an end plate 14 and at its other end 154 to a linkage 156. Linkage 156 is pivotally secured to a crank arm 158, which is keyed to dog shaft 34. Extension of linear hydraulic motor 150 causes linkage 156 to rotate crank arm 158 and lower end dog 32 into a log clamping position.

As shown in FIG. 9, upper roller arm assembly 40 and lower roller arm assembly 46 include torque adjusters 122 and their associated structure for biasing rollers 80, 86 against their respective vee rails. This is the arrangement for front carriage section 10. For back carriage section 11, the arrangement of fixed rollers and torque adjuster biased rollers is reversed. In general, for both carriage sections, the upper roller arm assembly that is behind the dog, or in other words outside of the dog, as is upper arm assembly 40 in FIG. 9, is the arm assembly that is to be provided with a torque adjuster 122. The lower arm assembly that is in front of or inside the dog, as is arm assembly 46 of FIG. 9, also is provided with a torque adjuster 122.

When a log is dogged, the log exerts a force, as shown by arrow 159, on dog 32. As a result, arm assemblies 40, 46 want to lift off of their vee rails, as indicated by arrows 160. Arm assemblies 42, 44, on the other hand, are pressed against the vee rails by force 159 and thus, carry the load and guide the carriage. When the carriages are empty, i.e. no log is dogged, torque adjusters 122 keep the rollers of arm assemblies 40, 46 biased against their respective vee rails.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed:

1. A log delivery system comprising:

a conveyor track including a main carriage support beam, an upper rail on the main beam, and a lower rail on the main beam, the upper rail including an inwardly, upwardly-inclined rail surface and an outwardly, upwardly-inclined rail surface, and the lower rail including an inwardly, downwardly-inclined rail surface and an outwardly, downwardly-inclined rail surface, and front and back carriage sections mounted for longitudinal movement along the main beam, each including:

(a) a dog for clamping a log, (b) an upper pair of rollers, and (c) a lower pair of rollers, the upper pair of rollers positioned to contact and roll on the inwardly, upwardly- and outwardly, upwardly-inclined rail surfaces of the main beam, the lower pair of rollers positioned to contact and roll against the inwardly, downwardly- and outwardly, downwardly-inclined rail surfaces of the main beam, the front and back carriage sections positioned on the same side of the main beam.

2. The log delivery system of claim 1, wherein the inwardly, upwardly-inclined and outwardly, upwardly-inclined rail surfaces are oriented ninety degrees to each other, and the inwardly, downwardly and outwardly, downwardly inclined rail surfaces are oriented ninety degrees to each other.

3. The log delivery system of claim 2, wherein the upper rollers are oriented ninety degrees to each other, and the lower rollers are oriented ninety degrees to each other.

4. The log delivery system of claim 1, wherein each front and back carriage sections includes a second pair of upper rollers and a second pair of lower rollers, the second pairs of rollers being spaced longitudinally from the first pairs of rollers.

5. The log delivery system of claim 4, wherein each carriage section includes torque means for biasing one of the upper pair and one of the lower pair of rollers against a rail surface.

6. The log delivery system of claim 5, wherein the front and back carriage sections are adapted to dog a log between their respective dogs, and wherein the pairs of upper rollers comprise an inner pair of rollers and an outer pair of rollers, the inner pair of rollers being above a dogged log, the outer pair of rollers being outside of the dogs, and wherein the inner pair of rollers are provided with the torque means.

7. The log delivery system of claim 6, wherein the pairs of lower rollers comprise an inner pair of rollers and an outer pair of rollers, the inner pair of rollers being above a dogged log and the outer pair of rollers being outside of the dogs, and wherein the outer pair of rollers are provided with a torque means.

8. The log delivery system of claim 4, wherein each carriage includes a torque mechanism for biasing one of the upper pairs of rollers and one of the lower pairs of rollers against their respective rail surfaces.

9. The log delivery system of claim 8, wherein the torque mechanism includes a torque shaft rotatably carried by the carriage, the biased pair of rollers being rotatably carried by the torque shaft, and further including a torque adjuster for selectively providing a torque on the torque shaft.

10. The log delivery system of claim 9, wherein the torque adjuster includes a threaded bolt threadably secured to the torque shaft, the end of the threaded bolt adapted to engage a portion of the carriage.

11. The log delivery system of claim 1, wherein the dog is mounted to a dog shaft, which is rotatably carried by a carriage, the dog shaft being carried by the carriage at an angle from horizontal such that the dog is mounted to the dog shaft at an angle from vertical.

12. The log delivery system of claim 11, wherein the distal end of each dog is aligned with the vertical centerline of the main beam and the upper portion of each dog is laterally outwardly of the vertical centerline.

13. The log delivery system of claim 12, wherein the dog each carriage is dog leg in design, with its upper portion offset outwardly from its lower portion.

14. A log delivery system including a pair of carriages, carriage A and carriage B, each carriage including a pair of carriage sections for dogging a log and feeding the log through a cutting station, the carriage sections each including a dog for clamping the log, the dogs being extendable to a lowered position to clamp a log and being retractable to a raised position to release a log, carriages A and B adapted to move on opposite sides of a conveyor track so that it is possible for the carriages to move past one another, wherein the improvement comprises the dog of each carriage section being slanted so that the distal end of the dog is laterally inwardly of the upper, mounted end of the dog, wherein, with the dogs of carriages A and B in their lowered dog clamping position, the distal ends of the dogs will intercept each other should the carriages move past each other, but with the dogs of either carriage A or carriage B raised, or with the dogs of both carriages raised, the carriages can move past each other with contact between the carriages.

15. The log delivery system of claim 14, wherein the dog of each carriage is mounted to a dog shaft, which is rotatably carried by a carriage, the dog shaft being carried by the carriage at an angle from horizontal such that the dog is mounted to the dog shaft at an angle from vertical.

16. The log delivery system of claim 15, wherein each carriage has an outer side and an inner side, the inner sides of each carriage face each other and the outer sides face away from the carriages, and wherein the dog shaft of each carriage is angled so that the end of the dog shaft adjacent the inner side of the carriage is above the end of the dog shaft adjacent the outer side of the carriage, and thus, the upper end of the dog shaft is located outwardly of the lower end of the dog shaft.

17. The log delivery system of claim 15, wherein the dog of each carriage is dog leg in design, with its upper portion offset outwardly from its lower portion.

* * * * *